US007267508B2

(12) United States Patent
Kaster

(10) Patent No.: US 7,267,508 B2
(45) Date of Patent: Sep. 11, 2007

(54) SATELLITE SYSTEM FOR SHALLOW DIVING

(76) Inventor: Fernando Guilherme Castanheira Kaster, Estrada do Piaí, N° 4027 - Sepetiba, Rio de Janeiro (BR)

( * ) Notice: Subject to any disclaimer, the term of this patent is extended or adjusted under 35 U.S.C. 154(b) by 0 days.

(21) Appl. No.: 10/534,675

(22) PCT Filed: Nov. 5, 2003

(86) PCT No.: PCT/BR03/00155

§ 371 (c)(1),
(2), (4) Date: May 12, 2005

(87) PCT Pub. No.: WO2004/043779

PCT Pub. Date: May 27, 2004

(65) Prior Publication Data

US 2006/0165491 A1 Jul. 27, 2006

(30) Foreign Application Priority Data

Nov. 12, 2002 (BR) ..... PI 0204633

(51) Int. Cl.
*B63C 11/00* (2006.01)

(52) U.S. Cl. ..... 405/185

(58) Field of Classification Search ..... 405/185–191
See application file for complete search history.

(56) References Cited

U.S. PATENT DOCUMENTS 4,208,152 A * 6/1980 Colston ..... 405/186
4,390,305 A * 6/1983 Sloan ..... 405/186
5,100,261 A * 3/1992 Plemon ..... 405/186
5,727,906 A * 3/1998 Nuckols et al. ..... 405/186

* cited by examiner

*Primary Examiner*—Frederick L. Lagman
(74) *Attorney, Agent, or Firm*—TraskBritt

(57) ABSTRACT

The present invention refers to a shallow diving system in open sea that consists of a main vessel (2) provided with dynamic positioning system (DP) and with the equipments to monitor diving operations, and give assistance and orientation to the divers (6). The main vessel (2) operates with support vessels (3), and together they set the divers (6) and support team at the work location (4), at a safe distance from the main vessel propulsion system, to perform the job on the offshore units (1). These vessels for supporting diving operation, act like satellites of the main vessel, linked to it by means of a umbilical line (5).

7 Claims, 2 Drawing Sheets

SATELLITE SYSTEM FOR SHALLOW DIVING

FIELD OF THE INVENTION

The present invention deals with a shallow diving system (up to 50 meters), carried out in open sea for the main objective of inspecting, sub aquatic surveying and repairing services in offshore installations, as for example platforms, vessels and equipments that work continuously at the sea.

To reach such an objective, the diving system operates externally the offshore installation where the service is required, in a main vessel provided with dynamic positioning system, and where are arranged the support equipment necessary to the diving operation.

The main vessel is suitably positioned nearby the location where the diving will be executed, using a secondary vessel for direct support and assistance.

This secondary vessel functions like a satellite of the main vessel.

BACKGROUND OF THE INVENTION

Nowadays, the shallow diving systems used in oil exploitation and production offshore platforms that operate in deep waters are based and operated from the same unit where the inspecting work will be performed.

In offshore platforms the physical space is limited. After installing exploitation systems, their facilities, safety systems, accommodations, loading areas, winches, cranes, heliport and escape routes, there are few remaining spaces on board.

Diving systems in use are arranged in these remaining spaces, and they utilize as a transportation mean to access the submerse region, an open bottom diving bell or basket, that is kept suspended and vertically lowered by means of an articulated structure that extends outside the platform structure. These systems, however, can only control the open bottom diving bell positioning in the vertical direction, the necessary horizontal displacement is obtained by moving the divers away from it, at the depth work, by using an umbilical line that links them. Due to the few available space for installing the diving equipments, the distances between diving places and work places demand the use of long umbilical lines, that require a greater physical effort from the divers, and increase considerably the risk of the operation that may become unsafe or not be feasible in different points of the unit.

Many occurrences have demonstrated that the arrangements made for launching and rescuing the divers, as those used for shallow diving systems, located in platforms, could not guarantee the immediate rescue of injured/endangered divers.

Generally the only way for doing the rescue, is with the open bottom diving bell itself or the diving basket, that most of the time can not be placed where the diver is, or can not be immediately raised due to untangled umbilical lines and/or other reasons.

Floating production, storage and off-loading units, known as FPSO, that are authorized to operate for periods up to twenty years, without dry-docking, have their structural integrity verified by programmed sub aquatic surveys, together with non destructive test (NDT) inspection, in all the hull extension, and the execution of the repairs identified as necessary.

The activities comprised in the job for sub aquatic inspection and repairing demand a peculiar structure entirely dedicated, with facilities to give support to the divers' life and adequate working conditions, safety and effectiveness for the job.

The optimization of space on the production units clearly indicates that an improvement in the actual operating conditions for diving systems will be reached only with an evolution within the concept that overtakes the present critical points, listed bellow:

- difficulty in rescuing the divers in an emergency situation;
- short range for the horizontal reaching capability, limited by the umbilical line length that can be handled securely;
- great difficulty to access different points of the platforms;
- divers physical effort due to the use of long umbilical line;
- necessity to move (re install) the support equipments;
- there is the need of two men in the water: one man working, and the other to handle the umbilical line, from the open bottom diving bell or basket;
- any emergency assistance or rescue activity become more difficult to provide since the other persons remain on the platform deck, 15 meters above;
- delivering material and tools to the divers, at their work location;
- job poor performance figures;
- no space on the platforms for the installation of support equipments;
- no accommodations for extra crew;

SUMMARY OF THE INVENTION

The present invention is a new concept of shallow diving system (up to 50 meters), in open sea, that is a safer and a more efficient alternative to carry out this job, which makes possible for the divers to move around in order to get access and operate in safe conditions in all points of the hull. The diving system, including all the support equipment, operates from another vessel, provided with dynamic positioning system, located nearby the job place, on board of which are arranged the auxiliary equipment necessary to support the diving operation.

The system now proposed consists of a main vessel, provided with a dynamic positioning system (DP) and with the equipments to monitor the diving operation, to give assistance and orientation to the divers. The main vessel operates with support vessels, and together they set the divers and the support team at the work location, at a safe distance from the main vessel propulsion system.

These vessels for direct supporting the diving operation, act like satellites of the main vessel, linked to it by means of umbilical lines.

DETAILED DESCRIPTION OF THE INVENTION

Figure 1:
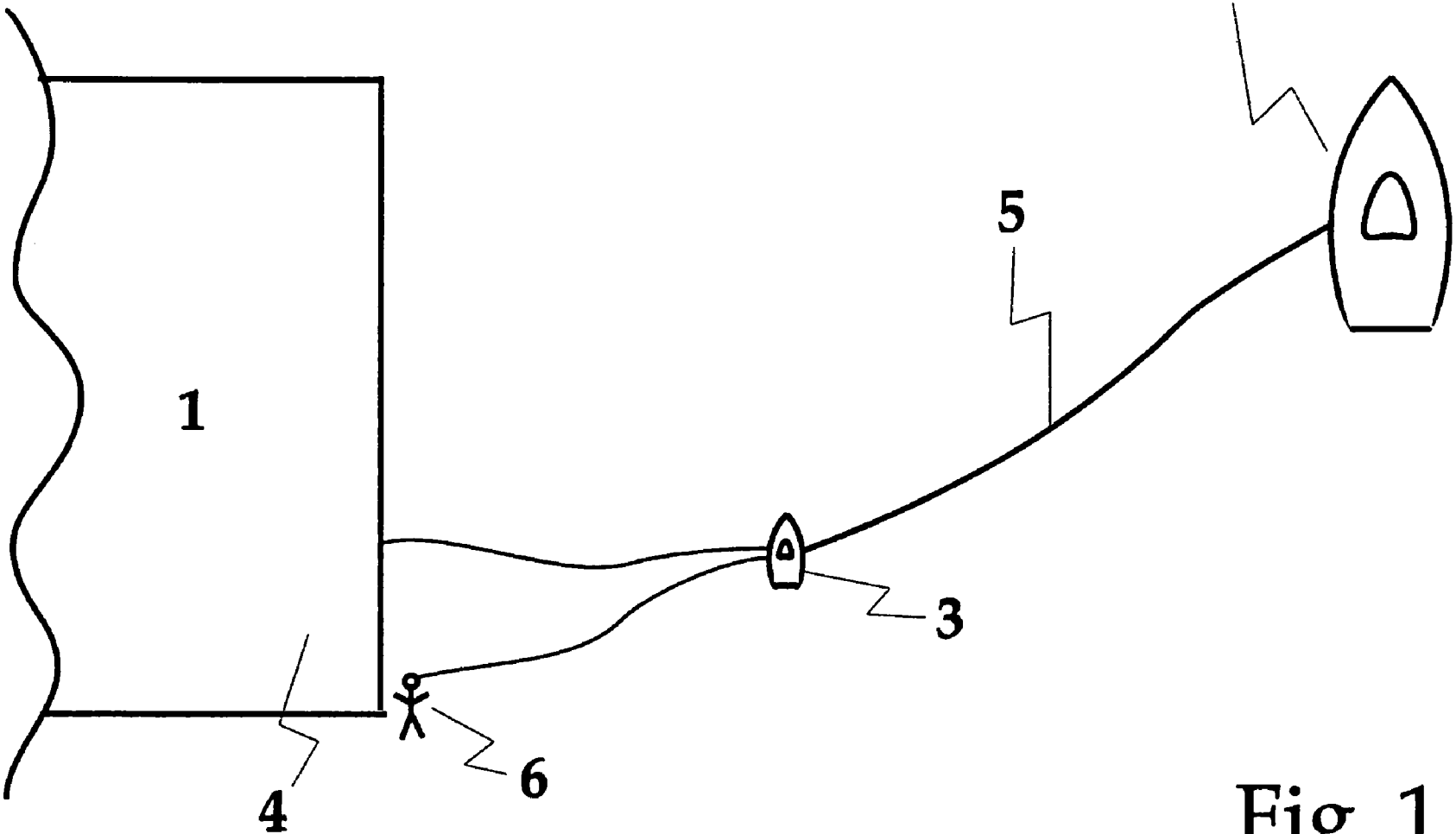
FIG. 1 shows a schematic plan view of the diving system object of the present invention.
Figure 2:
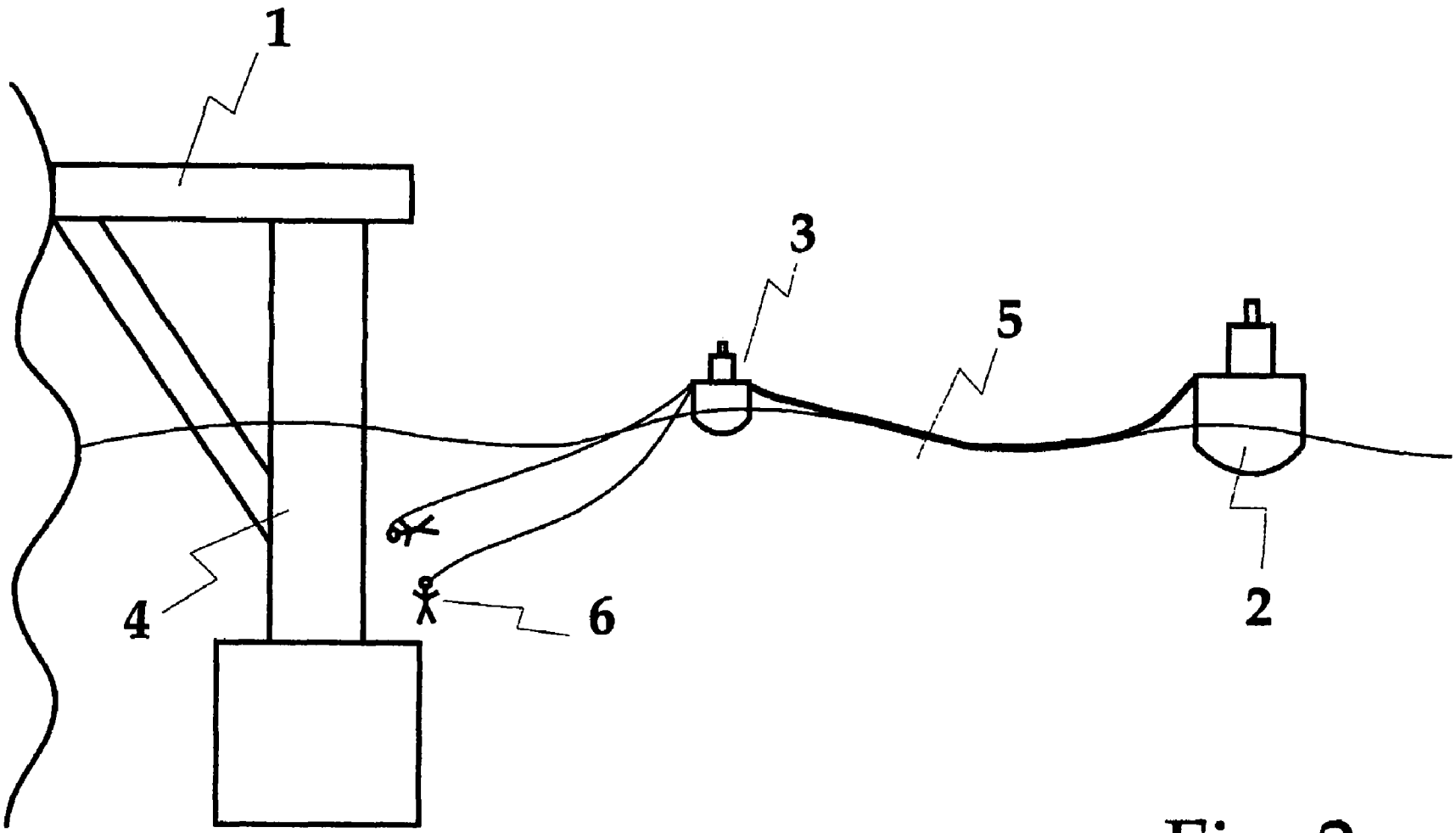
FIG. 2 represents a schematic profile view of the system presented in FIG. 1.

The invention will be better understood if described together with the Figures, which are part of this report.

The shallow diving system in open sea utilizes a vessel, named main vessel 2, which is positioned nearby the installation unit 1, and is used as a base for working, that operates together with an auxiliary support vessel 3, smaller, referred as diving boat, from now on.

The main vessel 2 is provided with a dynamic positioning system, an uninterrupted power generation system for the diving system, capable of assure the divers' decompression in emergency situation but, in accordance with the procedures adopted during normal conditions, and being able to comply with the legal regulations established for shallow diving operations.

The diving boat, vessel 3, must provide the operational and safety utilities. It must have redundancy in the propulsion power system by dual water jet units in order to guarantee the motion, positioning and protection of the people in the water, and also have a control panel for three divers, two actually diving and one diver in safety "stand by", an operation control panel to make possible a complete control and follow-up, through audio, video and registered data, of the supplied pressures and depths, and a video camera for each diver in the water and one camera placed under the hull. That means audio and video communication, to guide and register the operations, from the main diving control center, located near the dynamic positioning system control in the main vessel, up to the divers working in the water, with control of the diving supervisor in the diving boat.

Further, the diving boat must have an emergency air compression system, which consists of two high pressure bottles with enough capacity to decompress two divers (about 60 liters/3000 psi), considering the maximum time foreseen in a 50 meters diving.

The diving boat shall have an arrangement to handle the diving umbilical lines, space for a stretcher with a person laying down, equipment for first aid and be able to transport eight people, as a minimum, i.e., a diving supervisor, two support divers, one diver as in stand by, two official divers, one boat operator and one auxiliary man.

DESCRIPTION OF THE PREFERRED EMBODIMENT

According to previous description, the main vessel 2 must have the accommodations for the crew and the diving system team, space to assemble the auxiliary equipment, and be a fixed referenced platform for the whole system positioning. When it is positioned nearby the unit in the sea, installation 1, it shall make possible the correct positioning of the diving boat, vessel 3, on the desired work location, indicated as 4. The diving boat 3, connected to the main vessel 2 by means of supply umbilical, indicated as 5, render possible the assistance and support to the diving operation, from a point at the surface straight above the desired work location, and also provide a minimum distance between the divers, indicated as 6, and the main vessel propeller system for a safe operation (about 30 meters).

The umbilical line has positive buoyancy and is used as an auxiliary device for the positioning of the diving boat in relation to the main vessel.

During the diving operation the umbilical line is kept at the proper length and tension in the desired direction by the diving boat puling on the line, the load is applied and controlled by the diving boat and this keeps the desired diving position stable.

Among other advantages the following ones are emphasized:

- the divers and the team for supporting the diving activity work as near as possible to the desired work location;
- guarantee immediate rescue of the divers in emergency conditions;
- improve the assistance to the divers in normal conditions by facilitating the delivering of tools and material to do the job;
- make feasible the work of two divers concomitantly, with a third one as a safety stand-by diver, inside the diving boat;
- provide an unlimited supply, from the main vessel, of the utilities required for normal diving operation conditions, through the umbilical line that connects the diving boat to the main vessel, that also limits the maximum distance between the boats;
- guarantee the diving boat autonomy in relation to the diving systems provisions, and position keeping capabilities to stay at the desired position after disconnecting the umbilical line that links it to the main vessel, in order to realize the rescue of the divers safely in emergency conditions;
- redundancy in the launching and rescue systems of the diving boat, provided that the operation may be executed with the boat at its full capacity, with the crew inside it.

An extraordinary improvement in job performance comes forth when using this new concept for shallow diving system, and is clearly noticed by those with a skill in the art.

The invention claimed is:

1. Satellite system for shallow diving in open sea comprising a main vessel provided with a dynamic positioning system, and with equipment to monitor a diving operation, to give assistance and orientation to divers; the main vessel operates with at least one support vessel, said at least one support vessel being connected to the main vessel by means of an umbilical line, said umbilical line having a positive buoyancy and said main vessel and said at least one support vessel together setting the divers and a support team at a work location, at a safe distance from a propulsion system of the main vessel.

2. Satellite system for shallow diving in open sea according to claim 1, wherein the main vessel is used as base for diving work.

3. Satellite system for shallow diving in open sea according to claim 1, wherein the umbilical line is used for positioning the at least one support vessel relative to the main vessel.

4. Satellite system for shallow diving in open sea according to claim 1, characterized by the main vessel being used as base for diving work.

5. Satellite system for shallow diving in open sea comprising a main vessel provided with a dynamic positioning system, and with equipment to monitor a diving operation, to give assistance and orientation to the divers, the main vessel operates with support vessels, the support vessels being connected to the main vessel by an umbilical line, said support vessels supporting a diving operation from a point at the surface of said open sea, above a work location, said main vessel and said support vessels together setting the divers and a support team at said work location, at a safe distance from a propulsion system of the main vessel.

6. Satellite system for shallow diving in open sea comprising a main vessel provided with a dynamic positioning system, and with equipment to monitor a diving operation, to give assistance and orientation to divers; the main vessel operates with at least one support vessel, said at least one support vessel being connected to the main vessel by means of an umbilical line, and said main vessel and said at least one support vessel together setting the divers and a support team at a work location, at a safe distance from a propulsion system of the main vessel said at least one support vessel supporting a diving operation from a point at the surface of said open sea, above the work location (4).

7. Satellite system for shallow diving in open sea according to claim 6, wherein the umbilical line is used for positioning the at least one support vessel relative to the main vessel.

* * * * *